United States Patent [19]

Linnert et al.

[11] 4,353,682

[45] Oct. 12, 1982

[54] RECIPROCATING GAS COMPRESSOR HAVING SUCTION SHUT-OFF UNLOADING MEANS

[75] Inventors: Peter J. Linnert; James R. Quinn, both of La Crosse, Wis.

[73] Assignee: The Trane Company, La Crosse, Wis.

[21] Appl. No.: 189,485

[22] Filed: Sep. 22, 1980

[51] Int. Cl.[3] ..... F04B 49/02; F04B 35/04

[52] U.S. Cl. ..... 417/295; 417/441; 417/415

[58] Field of Search ..... 417/295, 441, 415

[56] References Cited

U.S. PATENT DOCUMENTS

| | | | |
|---|---|---|---|
| 2,350,537 | 6/1944 | Scott | 230/31 |
| 3,061,176 | 10/1962 | Nicholas et al. | 230/30 |
| 3,578,883 | 5/1971 | Cheney | 417/286 |
| 3,671,147 | 6/1972 | Lauchs et al. | 417/286 |
| 4,065,229 | 12/1977 | Black | 417/270 |

*Primary Examiner*—Richard E. Gluck

*Attorney, Agent, or Firm*—Carl M. Lewis; Peter D. Ferguson; Ronald M. Anderson

[57] ABSTRACT

A reciprocating gas compressor of the multicylinder, radial type is disclosed which includes unloading means for selectively shutting off suction gas flow to one or more of the cylinders in order to vary the capacity of the compressor. The unloading means include a valve element having a flat, planar surface which is movable between first and second positions with respect to a generally planar valve seat surrounding the inlet of the suction flow passage means, which inlet is spaced radially from the crankshaft axis and lies in a plane substantially perpendicular thereto.

18 Claims, 2 Drawing Figures

RECIPROCATING GAS COMPRESSOR HAVING SUCTION SHUT-OFF UNLOADING MEANS

DESCRIPTION

1. Technical Field

The present invention relates generally to the field of reciprocating gas compressors and, specifically, is directed to a reciprocating gas compressor of the multi-cylinder, radial type having special application in the field of refrigeration and air conditioning, and wherein means are provided for unloading one or more cylinders of the compressor by shutting off suction gas flow thereto.

2. Background Art

In the field of refrigeration and air conditioning, one of the most common systems currently in use is the vapor compression refrigeration cycle wherein a compressor is operative to compress a refrigerant gas such as Freon (a trademark of DuPont), the compressed gas being passed to a condenser and then to an evaporator wherein a cooling effect is realized. With today's increased emphasis on energy conservation, it has become important that refrigeration systems of this type be capable of supplying only the cooling effect required at a given time, thereby giving rise to a need for reciprocating compressors having the capability of operating at variable capacities. While such compressors have been available for many years for refrigeration systems in relatively large tonnage ranges, a special need exists today with respect to systems of smaller tonnage capacity; e.g., in the range of 3-15 tons. A further requirement for variable capacity compressors in this size range is that they be compact and relatively inexpensive to manufacture, so as to be competitive in the marketplace.

One of the most efficient methods of varying the capacity of a reciprocating gas compressor is simply to shut off the suction gas supply to one or more cylinders of the compressor. This technique is disclosed in U.S. Pat. Nos. 2,350,537; 3,061,176; 3,578,883; and 3,671,147. Of these references, only U.S. Pat. No. 3,671,147 relates to a compressor of hermetic design as might be used in refrigeration systems of smaller tonnage ranges. However, the compressor disclosed therein includes a relatively complex suction flow passage arrangement, including the valve means for selectively shutting off gas flow to one or more of the cylinders, an arrangement which would be relatively expensive to manufacture compared to the compressor disclosed herein, as will appear later.

DISCLOSURE OF THE INVENTION

The present invention is directed to a compressor of the "radial" type wherein a plurality of cylinder bores extend radially from and are spaced circumferentially about a central axis, with a crankshaft extending along the central axis in order to impart reciprocating motion to pistons disposed within the cylinder bores. Each cylinder bore has associated therewith suction flow passage means for conveying gas thereto, and the suction flow passage means of at least one of the cylinder bores is provided with an inlet spaced radially from the central axis and includes a valve seat comprising a generally planar surface surrounding the inlet to the suction flow passage means, which planar surface lies in a plane substantially perpendicular to the central axis of the compressor. Unloader valve means are provided in the form of a valve element having a generally flat, planar surface, which valve element is supported for a movement between a first position in overlying relationship to the valve seat, and a second position removed therefrom.

In a preferred embodiment, the valve member comprises a relatively thin, flat, flexible member which is affixed at a first portion to the compressor housing and extends therefrom to a second portion in overlying relationship to the valve seat, and wherein actuator means are operative to flex the valve element between the first position in overlying relationship to the second position removed therefrom.

The suction flow passage means associated with each cylinder bore preferably include axial passage means which extend in a direction from its associated cylinder substantially parallel to the central axis of the compressor, terminating in the valve seat, which axial passage means are in communication with annular passage means surrounding at least the radially outward end of its associated cylinder bore.

Actuator means for moving the valve element preferably comprise a cam member in contact therewith and means for pivoting the cam member such as a simple electrically operated solenoid.

BEST MODE FOR CARRYING OUT THE INVENTION

Figure 1:
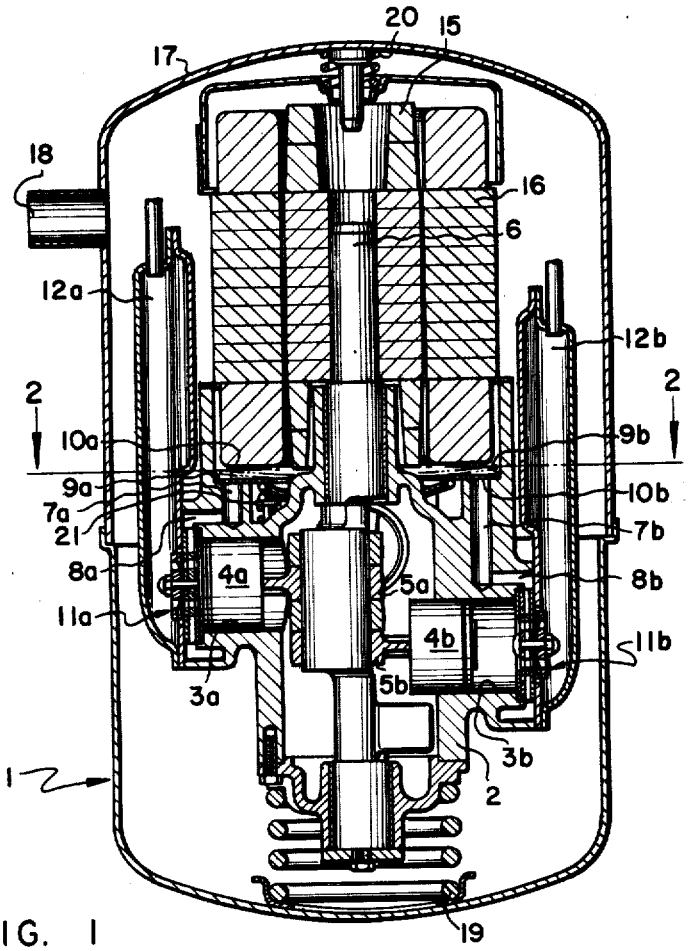
FIG. 1 is a vertical cross-sectional view of the compressor comprising the present invention, taken along the line 1—1 of FIG. 2.

Turning first to FIG. 1 of the drawings, a variable capacity reciprocating gas compressor is denoted generally by reference numeral 1 and includes a housing 2 which defines a plurality of cylinder bores, bores *3a* and *3b* being illustrated in FIG. 1, which cylinder bores extend radially from and are spaced circumferentially about a central axis defined by crankshaft 6. By reference to FIG. 2, it can be seen that a total of four such cylinder bores are provided equally spaced about the central axis. As is conventional, pistons *4a* and *4b* illustrated in FIG. 1 are disposed in each of the cylinder bores and are connected to crankshaft 6 by connecting means *5a, 5b*, such as connecting rods as shown or a suitable Scotch-yoke mechanism, such that reciprocating motion is imparted to the pistons upon rotation of the crankshaft, it being noted that crankshaft 6 is supported for rotation within housing 2 by conventional bearing means disposed at its upper and lower ends. As is further conventional, an electric drive motor is affixed to housing 2 and includes a rotor 15 pressed on the end of crankshaft 6 and a stator 16 which is bolted to the housing. The combined motor-compressor unit is supported within a hermetic casing or shell 17 by a lower helical support spring 19 and an upper helical support spring 20. A preferred support scheme is more fully disclosed and described in U.S. Pat. No. 4,200,426 commonly assigned with the present application, the disclosure of which is hereby incorporated herein.

Suction gas at a low pressure is supplied to shell 17 via an inlet conduit 18, which gas is then directed over the motor assembly prior to being admitted to the compressor housing; while compressed gas exits the compressor via mufflers 12*a*, 12*b* and attached discharge conduits.

Suction flow passage means are defined within housing 2 and, in the preferred embodiment, comprise annular passage means 8*a*, 8*b* surrounding at least the radially outward end of each cylinder bore, and axial passage means 7*a*, 7*b* extending in a direction from its associated cylinder bore substantially parallel to the central axis of crankshaft 6.

As clearly illustrated in FIG. 1, the axial flow passage means 7*a* and 7*b* each have an inlet which is spaced radially from the aforementioned central axis and include a valve seat 9*a* and 9*b*, respectively, comprising a generally planar surface surrounding the inlet and lying in a plane which is substantially perpendicular to the central axis. As more clearly illustrated in FIG. 2, the inlets actually comprise a plurality of circular bores arranged generally circumferentially about the central axis, which bores intersect annular flow passage means 8*a*, 8*b*; while valve seats 9*a*, 9*b* comprise a continuous, generally planar surface surrounding the inlets to the bores. While bores 7*a*, 7*b* are illustrated as being substantially parallel to the axis of crankshaft 6, the term "substantially parallel" as applied thereto is intended to encompass the situation where the bores are inclined slightly radially outwardly, as might be required in order to provide clearance for drilling tools during manufacture. Alternatively, passage means 7*a*, 7*b* may each comprise a crescent-shaped passage, formed by a core during the casting of housing 2, which passage would generally encompass the overall area encompassed by the four bores illustrated.

As should now be apparent, suction gas is free to flow into cylinders 3*a* and 3*b*, assuming valve members 10*a* and 10*b* are in their dotted-line open position (as will be described in detail hereinafter), such gas flow being under the control of valve plates 11*a* and 11*b*, respectively, which valve plates are of generally conventional construction and may be those fully disclosed and described in U.S. Pat. No. 4,027,853 commonly assigned with the subject application, the disclosure of which is hereby incorporated herein.

Figure 2:
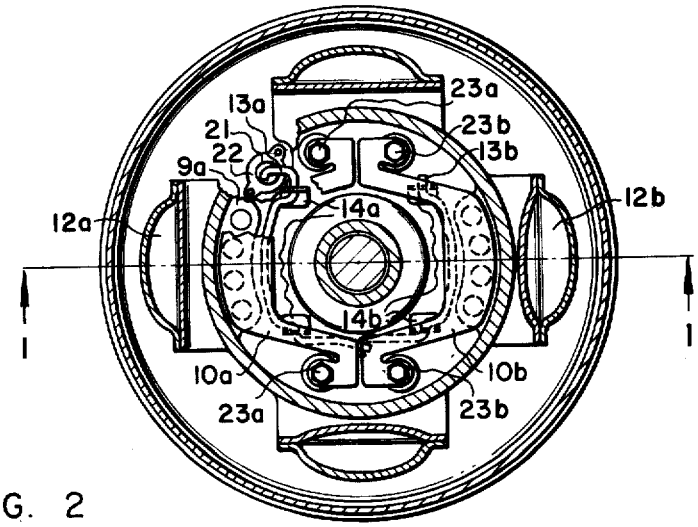
FIG. 2 is a horizontal cross-sectional view of the compressor comprising the present invention, taken along the line 2—2 of FIG. 1.

In order to vary the capacity of compressor 1, unloader valve means are provided for selectively shutting off gas flow through the suction flow passage means of at least one of the cylinder bores and, in the preferred embodiment illustrated, both cylinders 3*a* and 3*b* may be simultaneously unloaded, with the other two remaining cylinders continuing to be operative. The unloader valve means for selectively shutting off gas flow through suction flow passage means 7*a*, 8*a*; and 7*b*, 8*b* comprise respective valve elements 10*a*, and 10*b* each of which includes a generally flat planar surface having a shape corresponding to that of valve seats 9*a* and 9*b*, respectively, as best illustrated in FIG. 2. Valve elements 10*a*, 10*b* are of generally U-shaped configuration having a bight portion defining its generally flat, planar surface, and two arm portions extending from opposite ends thereof. Conveniently, the arm portions extend toward crankshaft 6 with one positioned on each side thereof, resulting in a compact arrangement of parts. By further reference to FIG. 2, it can be seen that valve elements 10*a* and 10*b* are supported on housing 2 by two bolts 23*a*, 23*b* at the arm portions of the U-shaped valve members.

Valve elements 10*a* and 10*b* are constructed from a relatively thin, flat, flexible material such as spring steel or high carbon steel and actuator means are provided for moving the valve elements between a first position in overlying relationship to valve seats 9*a* and 9*b*, respectively; and a second position removed therefrom whereby gas flow through the associated suction flow passage means is permitted. Reference may be had to FIG. 1 wherein valve elements 10*a* and 10*b* are shown in their first positions in full line, and their second, open positions in dotted line.

In order to move valve elements 10*a* and 10*b* between their first and second positions, actuator means are provided which include respective cam members 13*a* and 13*b* supported for pivotal movement by supports 14*a* and 14*b*, respectively. From FIG. 1 it can be seen that, upon movement of cam members 13*a* and 13*b*, they are operative to flex valve elements 10*a* and 10*b* through contact with the underside thereof. As best shown in FIG. 2, cam member 13*a* is pivoted by a solenoid 22 having a plunger 21 which may be a simple electrically actuated solenoid or, in the alternative, could comprise a pressure actuated power cylinder utilizing high pressure refrigerant gas as the actuating medium. Upon energization of solenoid 22, valve elements 10*a*, 10*b* would be held in their second, open positions while, upon deenergization thereof, the flexible nature of the valve elements would cause them to return to their first, closed positions. Cam member 13*b* includes an arm portion in contact with an arm portion of cam member 13*a* such that, upon pivotal movement of cam member 13*a*, cam member 13*b* is also pivoted. Thus, upon actuation of solenoid 22, both cylinders 3*a* and 3*b* will be simultaneously moved to either a loaded or unloaded position.

From the foregoing description, it should be apparent that the present invention provides a relatively simple and inexpensive solution to the problem of providing variable capacity capability for a gas compressor of the radial type. The machining operations required for forming axial suction flow passage means 7*a* are simple drilling operations and valve seats 9*a* and 9*b* may be conveniently machined in conjunction with other machining operations required on that side of the casting forming housing 2. Moreover, it should especially be noted that the resulting variable capacity compressor retains essentially the same size as if it were not provided with the variable capacity feature, unloader valve means 10*a* and 10*b*, respectively, occupying a very small area between the motor and housing 2.

It should be specifically noted that, while the invention is disclosed in terms of a four-cylinder radial compressor having two cylinders unloadable, the invention is equally applicable to compressors having two or three cylinders, or in excess of four cylinders, and that the number of cylinders to be provided with unloading capability is primarily a matter of choice depending upon the required application. For example, if a three cylinder compressor were involved, only one cylinder might be unloadable; while with a four cylinder compressor it may be desirable that multiple stages of unloading be provided, that is, that two cylinders be provided with unloading capability but with individual actuator means for each such that one or two cylinders could be selectively unloaded at a given time.

It may further be noted that the specific actuator means disclosed in the subject application, that of an electrically operated solenoid and plunger in combination with a cam member, is not critical to operation of the invention and other equivalent actuating schemes could be provided so long as they provided the requisite movement of the valve elements. Further, although a flexible type valve element is disclosed herein as a preferred embodiment, it is possible that a rigid valve element could be employed which is suitably supported for movement between first and second positions without flexure thereof.

It may likewise be noted that, in the embodiment illustrated, solenoid 22 is energized in order to move the valve elements to their open, loaded positions, it is within the scope of the invention that solenoid 22 could be spring-biased to the open, loaded position, and energized in order to unload the compressor.

Thus, while the invention has been disclosed with respect to the preferred embodiment illustrated in FIGS. 1 and 2, it is to be understood that modifications thereto will become apparent to those skilled in the art, and the scope of the invention is to be ascertained by reference to the claims which follow.

We claim:

1. A variable capacity reciprocating gas compressor comprising a. a housing defining a plurality of cylinder bores extending radially from and spaced circumferentially about a central axis;

b. a piston disposed in each of said cylinder bores;

c. a crankshaft extending along said central axis and supported for rotation within said housing;

d. means connecting each of said pistons to the crankshaft such that the pistons undergo reciprocating motion within their respective cylinder bores upon rotation of said crankshaft;

e. suction flow passage means associated with each of said cylinder bores for conveying gas thereto, the suction flow passage means of at least one of said cylinder bores having an inlet spaced radially from said central axis and including a valve seat comprising a generally planar surface surrounding said inlet and lying in a plane substantially perpendicular to said central axis, and valve plate means associated with each cylinder bore for controlling gas flow with respect thereto;

f. unloader valve means for selectively shutting off gas flow through the suction flow passage means of said at least one cylinder bore and comprising i. a valve element having a generally flat, planar surface;

ii. means supporting said valve element for movement between a first position wherein its planar surface lies in overlying relationship to the planar surface of said valve seat, whereby gas flow therethrough is prevented; and a second position removed from said valve seat whereby gas flow therethrough is permitted; and iii. actuator means for moving said valve element between said first and second positions.

2. The compressor of claim 1 wherein the suction flow passage means of said at least one cylinder bore includes axial passage means extending in a direction from its associated cylinder bore substantially parallel to said central axis, terminating at said valve seat.

3. The compressor of claim 2 wherein the suction flow passage means of said one cylinder bore further comprise annular passage means surrounding at least the radially outward end of its associated cylinder bore, said axial passage means intersecting said annular passage means.

4. The compressor of claim 2 wherein said axial passage means comprise a plurality of circular bores and said valve seat comprises a continuous, generally planar, surface surrounding the inlets to said bores, and the generally flat, planar surface of said valve element is of a shape corresponding to that of said valve seat.

5. The compressor of claim 1, 2, 3, or 4 wherein said suction flow passage means are formed within said housing.

6. The compressor of claim 5 wherein said valve seat comprises a generally planar surface machined on said housing.

7. The compressor of claim 1 wherein said valve element comprises a relatively thin, flat, member affixed at a first portion thereof to said housing, and extending therefrom to a second portion defining said generally flat, planar surface; and wherein said actuator means are operative to move said valve element between said first and second positions.

8. The compressor of claim 7 wherein said actuator means comprise a cam member in contact with said valve member and means for pivoting said cam member between first and second positions, whereby said valve element is moved between said first and second positions.

9. The compressor of claim 1 wherein said valve element comprises a relatively thin, flat, flexible member affixed at a first portion thereof to said housing, and extending therefrom to a second portion defining said generally flat, planar surface; and wherein said actuator means are operative to flex said valve element between said first and second positions.

10. The compressor of claim 9 wherein said actuator means comprise a cam member in contact with said valve member and means for pivoting said cam member between first and second positions, whereby said valve element is flexed between said first and second positions.

11. The compressor of claim 1 wherein said valve element comprises a relatively thin, flat member with one side thereof defining said generally flat, planar surface.

12. The compressor of claim 1 wherein said valve element is of generally U-shaped configuration having a bight portion which defines said generally flat, planar surface and two arm portions extending from opposite ends thereof.

13. The compressor of claim 12 wherein the bight portion of said U-shaped valve element is disposed transversely with respect to said cylinder bore, the arm portions thereof extending therefrom in a direction generally parallel to said cylinder bore and toward said central axis such that one arm portion lies on either side thereof.

14. The compressor of claim 12 or 13 wherein said valve element comprises a relatively thin, flat, member having its arm portions affixed to said housing and wherein said actuator means are operative to move said valve element between said first and second positions.

15. The compressor of claim 14 wherein said actuator means comprise a cam member in contact with said valve member and means for pivoting said cam member between first and second positions, whereby said valve element is moved between said first and second positions.

16. The compressor of claims 12 or 13 wherein said valve element comprises a relatively thin, flat, flexible member having its arm portions affixed to said housing and wherein said actuator means are operative to flex said valve element between said first and second positions.

17. The compressor of claim 16 wherein said actuator means comprise a cam member in contact with said valve element and means for pivoting said cam member between first and second positions, whereby said valve element is flexed between said first and second positions.

18. The compressor of claims 1, 2, 3, 4, 7, 8, 9, 10, 11, 12, or 13 further comprising an electric motor mounted on said housing in axial alignment with and drivingly connected to said crankshaft, the inlet to the suction flow passage means of said selected cylinder bore and its associated valve element lying between said motor and said housing.

* * * * *